United States Patent [19]

Kotlarz

[11] Patent Number: 4,957,289

[45] Date of Patent: Sep. 18, 1990

[54] BALL RETURN MECHANISM FOR A BASKETBALL GAME

[76] Inventor: Jeffery R. Kotlarz, 2402 Antonia La., Warren, Mich. 48091

[21] Appl. No.: 312,958

[22] Filed: Feb. 21, 1989

[51] Int. Cl.[5] ..... A63B 69/00

[52] U.S. Cl. ..... 273/1.5 A

[58] Field of Search ..... 273/1.5 A, 396, 397

[56] References Cited

U.S. PATENT DOCUMENTS 3,945,638 3/1976 Luebkeman ..... 273/1.5 A

*Primary Examiner*—Paul E. Shapiro

*Attorney, Agent, or Firm*—James R. Ignatowski; Remy J. VanOphem

[57] ABSTRACT

A ball return mechanism arranged for disposition directly beneath a circular basketball rim structure so as to automatically return the ball back to a shooter standing at or near the foul line. The mechanism includes two laterally spaced tubular rails angled downwardly and forwardly preferably at an angle of approximately forty-five degrees measured relative to the plane of the basketball rim. Rear end areas of the rails are pivotably attached to a clamp mechanism that is releasably mountable on a conventional bracket structure connecting the basketball rim to the basketball backboard. Flexible straps extend downwardly from the rim to resiliently support the front ends of the rails.

19 Claims, 1 Drawing Sheet

BALL RETURN MECHANISM FOR A BASKETBALL GAME

BACKGROUND OF THE INVENTION

1. Field of the Invention

This invention relates to a goal structure for the game of basketball and particularly to a ball return mechanism connectable to the rim of the goal structure which directs a basketball after it has passed downwardly through the rim to be returned to a shooter standing at or near the foul line on the basketball court.

2. Description of the Prior Art

The prior art includes disclosures of various different ball return mechanisms associated with the goal structure for the game of basketball. U.S. Pat. No. 3,233,896 to King discloses an elongated flexible chute structure extending between a basketball rim and a U-shaped support stand located at or near the foul line. The arrangement suffers in that the basketball would likely encounter significant resistance when passing through the chute, thereby taking an abnormally long time to reach the foul line or possibly becoming trapped at an intermediate point along the chute. Additionally, the ball is delivered to the shooter at the floor level, thereby requiring him to lean over to pick up the ball. Further, the chute structure is so prominent as to be distracting to the shooter, such that he is not able to view the basketball rim in the same way as he would under game conditions.

U.S. Pat. No. 3,814,421 to Spier, Jr. shows a ball return mechanism that takes the form of a rigid curved funnel structure attachable to a backboard via a frame structure. The funnel structure partially obscures the basketball net, such that the shooter has a somewhat different visualization of the target than he would under game conditions. Additionally, the funnel structure is a relatively large plastic molding that would have a relatively high unit manufacturing cost. Also, the frame structure is attachable to the backboard only after drilling holes at predetermined locations in the backboard surface. Some installation expertise and time would be required to achieve a reasonably functional final arrangement.

U.S. Pat. No. 3,799,543 to Steele, Jr. shows a ball deflector that includes three convergent straps having a connection with a spring-like ball deflector arm. The convergent arms are attached to the basketball rim by permanent magnets. One difficulty with the arrangement shown in this patent is the fact that the deflector arm is not capable of operably contacting a basketball when the ball is moving obliquely to the rim plane as it moves past the deflector arm. For example, if the ball is moving acutely away from the backboard, it will completely miss the deflector arm, as shown in FIG. 3. The patented arrangement requires that the ball strike the deflector arm at a precise angle in order to achieve a given trajectory back to a shooter standing at the foul line. In many instances, the ball would be deflected away from the shooter rather than toward the shooter. Also, it would seem that the use of permanent magnets as an attachment means would be unsatisfactory considering the fact that the basketball often impacts the rim with a reasonably large force sufficient to vibrate the rim so as to possibly dislodge the magnets.

U.S. Pat. No. 1,765,269 to Hatley shows a basketball retriever device that includes a large dish-like canvas member having opposite side edges thereof attached to widely spaced side rails. Upper ends of the rails are secured to the backboard via brackets. Screws are required to affix the brackets to the backboard. The retriever device appears to be of rather massive dimensions, such that it would be difficult for one man to set up and install. The device requires a foot rail positionable flatwise on a floor surface to hold the side rails in spaced apart relation. The foot rail would probably not function effectively on uneven outdoor surfaces. The device of U.S. Pat. No. 1,765,269 seems to be limited to indoor use in gymnasiums.

SUMMARY OF THE INVENTION

The present invention is directed to a ball return mechanism for a basketball game structure having two laterally spaced rails located directly below the rim of a basketball goal to intercept a basketball after it has passed downwardly through the rim. The laterally spaced rails are angled downwardly and away from the backboard so that the ball is directed to roll downwardly along the surfaces of the laterally spaced rails toward the shooter standing at or near the foul line of the basketball court. The foul line, or free throw line, is normally fifteen feet from the backboard.

One object of the invention is to provide a ball return mechanism that is relatively unobtrusive and not distracting to the shooter.

Another object of the invention is to provide a ball return mechanism that has relatively few component parts, whereby the device can be marketed at a relatively low selling price.

A further object of the invention is to provide a ball return mechanism that can be packaged into a relatively small size shipping container.

Still another object of the invention is a ball return mechanism that may be assembled by the purchaser without special tools.

A still further object of the invention is to provide a ball return mechanism that can be quickly and firmly attached to a conventional basketball goal structure without special tools or skills. A related object is to provide a ball return mechanism that can be installed on a goal structure without drilling holes in the backboard or otherwise defacing the goal structure. For regular play, the ball return mechanism can be detached from the universal clamp leaving the clamp fully intact and unobstructed.

Another object of the invention is a ball return mechanism that can be quickly detached from the clamp mechanism for regular play leaving the clamp mechanism attached to the bracket which attaches the rim to the backboard and the clamp mechanism, which remains attached to the bracket, does not interfere with regular play.

An additional object of the invention is to provide a ball return mechanism that consistently delivers the ball back to the center of the playing area regardless from where the player shoots the basketball. This offers a variety of practice drills.

These and other objects of the invention will become more apparent from reading the detailed description in conjunction with the appended figures.

DETAILED DESCRIPTION OF THE PREFERRED EMBODIMENT

Figures 1, 2, 3, 4:
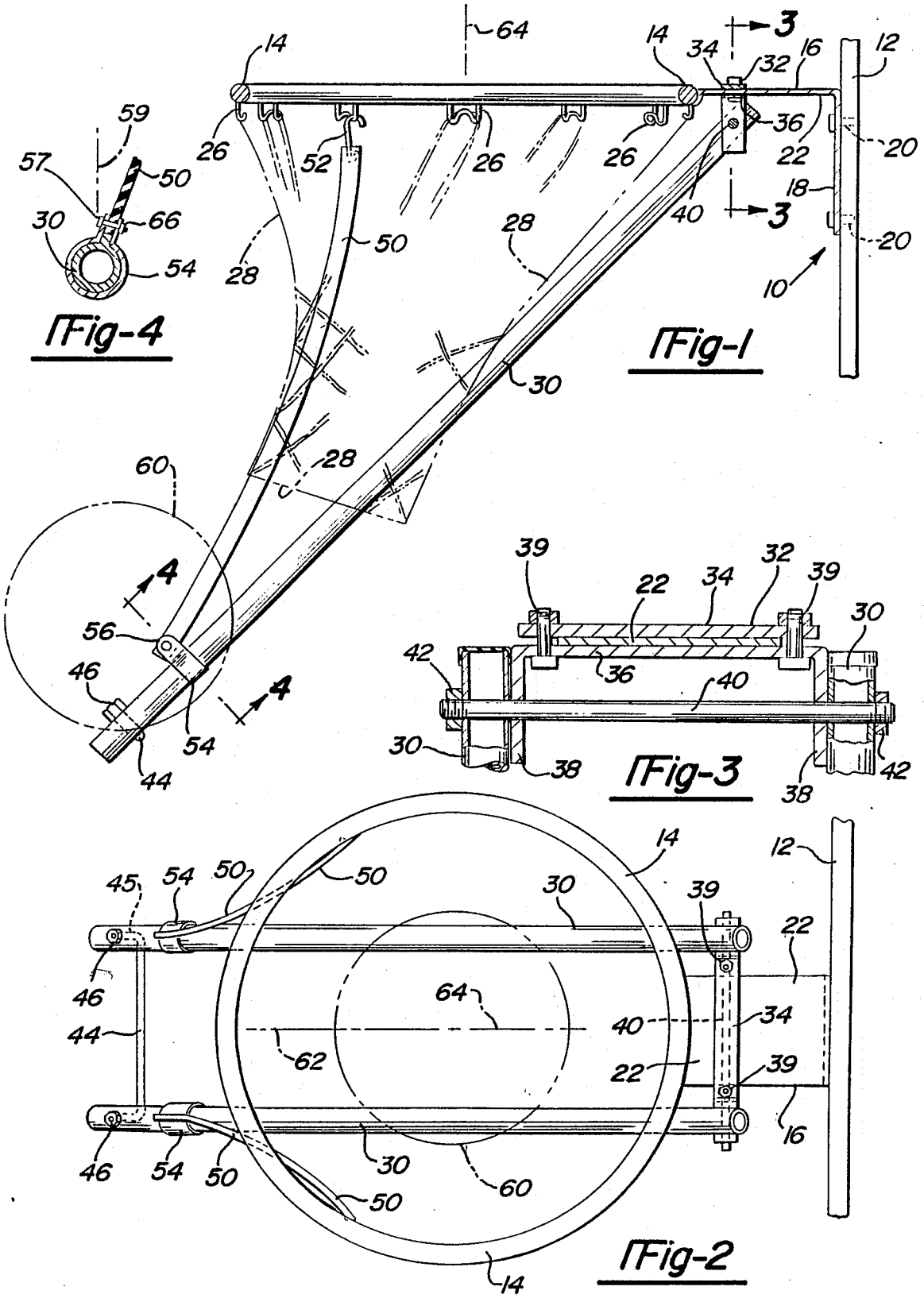
FIG. 1 is a partial cross sectional side view of a conventional basketball goal structure equipped with a ball return mechanism constructed according to the invention.
FIG. 2 is a top view of the assembly shown in FIG. 1.
FIG. 3 is an enlarged fragmentary sectional view taken along line 3—3 of FIG. 1.
FIG. 4 is a fragmentary sectional view taken along line 4—4 of FIG. 1.

The drawings show a conventional basketball goal structure 10 to which has been attached a ball return mechanism constructed according to the present invention. The goal structure will be described briefly to provide a clearer understanding of the invention's environment. The goal structure is not part of the present invention except to the extent that it is the structure to which the ball return mechanism is attached.

The goal structure 10 has a horizontally disposed circular rim 14, which is supported forward of a backboard 12 by a bracket structure 16. The bracket structure 16 has a flat vertical plate section 18 attached to the backboard 12 via screws 20, and a flat horizontal plate section 22 having a curved front flange welded to the rear edge of the circular rim 14. The support of the circular rim 14 can be supplemented by rod-like supports (not shown) extending diagonally between the vertical plate section 18 and the circular rim 14.

The circular rim 14 has twelve depending wire hooks 26 spaced equidistantly around the circumference of the rim to support a loosely woven net 28 below the circular rim 14. In FIG. 1, the outline of the net 28 is shown in phantom. The net 28 has a flexible funnel shape and may be constructed similarly to the net shown in the aforementioned U.S. Pat. No. 3,814,421. The net may be removed from the suspension hooks 26 when necessary, for example, for wintertime storage.

The ball return mechanism has two generally parallel rails 30, preferably formed of rigid plastic tubing having a circular cross section. As shown in FIG. 1, each rail 30 extends downwardly from the circular rim 14 and forwardly from the backboard 12 in the space directly below the circular rim. The preferred angularity for the rails 30 is between 30 and 60 degrees, measured from the horizontal plane of the circular rim 14. However, under given circumstances, the angularity of the rails is not limited to the preferred 30 to 60 degree range and may be any angle producing the desired objective.

Rear end areas of the rails 30 adjacent to the backboard 12 are pivotably connected to a multi-piece clamp mechanism 32 that is attached to the horizontal plate section 22 of the bracket structure 16. The clamp mechanism 32 has an upper bar plate 34 and a lower plate 36. Nut and bolt assemblies 39 are provided to draw the upper and lower plate components 34 and 36 toward one another to exert a frictional clamping force on the horizontal plate section 22 of the bracket structure 16. This method of attachment has been found to withstand forces normally encountered in the playing of a basketball game.

The lower plate 36 has two downwardly extending ears 38 that function as spacers for the rear ends of the rails 30. An elongated rod 40 extends through holes provided in the rails and mating holes provided in the associated ears 38 to pivotably support the rails at the ends adjacent to the backboard 12. Nuts 42 or other fasteners are applied to the ends of the rod 40 to hold the rod against axial dislocation. The ears 38 on the lower plate 36 act as spacers to space the rear ends of the rails 30 a predetermined distance apart.

Front end portions of the rails 30 are connected by a U-shaped cross member 44 that extends slightly below the rail lower surfaces. The ends 45 of the cross member 44 are upturned and extend through holes provided through the rails. Nuts 46 secure the cross member to the rails. The cross member 44 spaces the front ends of the rails 30 the same distance apart as the rear ends of the rails. The rail assembly can pivot as a unit around the axis of the rod 40.

The ball return mechanism further includes flexible straps 50 trained between the circular rim 14 and the rails 30. Each strap 50 can be formed of a flexible material such as rubber, although other materials can also be used. As shown in FIG. 1, the upper end of each strap 50 is provided with a metal hook 52 that is designed to engage one of the net suspension wire hooks 26. Preferably, the metal hooks 52 are connected to the net suspension hooks on the opposite sides of the circular rim 14 and about 15 degrees forward of a centerline passing through the center of the circular rim parallel to the backboard. The lower end of each strap 50 is connected to a spring clip 54 that substantially encircles an associated rail 30 near the rail's front end. Each spring clip 54 has two ears 56 that form an intervening space to receive the end portion of the associated strap 50. A bolt 57 extends through the strap 50 and ears 56 and is secured in place by a nut 66 as shown in FIG. 4. The resilient nature of the spring clip 54 holds the spring clip fast on the rails 30, while the strap 50 can pivot about the axis of the bolt 57. The spring clips 54 are preferably oriented with the ears 56 directed at an angle away from each other relative to a vertical plane 59, as shown in FIG. 4. This angular disposition of the ears 56 assures that they will not obstruct the path of the basketball as it rolls downwardly along the rails 30. Each strap 50 has a length that is sufficient to support the rails 30 at the desired angle.

As best seen in FIG. 2, the straps 50 converge toward one another from two widely spaced points on the side portions of the circular rim 14 to the rails 30 which are more closely spaced.

During assembly of the ball return mechanism, the straps 50 are attached to the spring clips 54 before attachment to the net suspension wire hooks 26. Under static conditions, the rails 30 do not exert a significant gravity force on the straps 50. Preferably the straps 50 extend upwardly within the envelope of the net 28 to make the connection with the appropriate wire hooks 26. However, it is not essential that the straps 50 be located within the net and the straps may be located outside the net envelope. If a particular installation has no net, the straps 50 will help to guide the basketball to the rails 30 after passing through the circular rim 14. The invention does not depend on the presence of a net 28 for operability; however, a net does enhance the operability of the ball return mechanism.

The rails 30 are spaced apart by a distance that is slightly less than the diameter of a conventional basketball 60, the outline of which is shown in phantom in FIGS. 1 and 2. The conventional basketball has a diameter of about nine and one half inches. The rails 30 are spaced apart a distance less than nine and one half inches so that the ball will be cradled within the rails as the ball rolls downwardly along their surface.

The rails 30 are located equidistantly in opposite transverse directions from an imaginary front-to-rear vertical center plane 62 that passes through a central axis 64 of the circular rim 14. The rails 30 are located so that the basketball must strike at least one of the rails after its downward passage through the circular rim 14. The basketball cannot pass through the spaces between the rails 30 and the circular rim 14 because the straps 50 inside of the net 28 restrain the displacement of the net from the region directly above the rails 30. Gravitational forces on the basketball, together with the deflectional action of the rails 30, cause the ball to move away from the backboard. The straps 50 restrain the net 28 from being displaced from directly above the rails and ensure that the ball will be directed to a central location on the rails 30 and the ball's centerline aligned with the front-to-rear centerplane 62.

If a net 28 is present, the basketball will initially contact the inner surface of the net. However, the rails 30 will still serve as ball deflection members and ball guide members. In actual practice, the basketball will exert sufficient downward force on the rails 30 to cause the rails to pivot downward about the pivot axis provided by the rod 40. This pivot motion is relatively small and generally not more than five degrees. The deflection of the rails 30 is beneficial in that it relieves some of the ball's impact force and thereby minimizes rebounding of the ball away from the rails. Thus, the ball is precluded from popping up and out through the circular rim 14 in a reverse direction, except under very unusual circumstances. The straps 50 act as suspension members for the rails 30, such that the rails preferably assume the angular position shown in FIG. 1. At the same time, the straps have flexibility and do not unduly restrain a downward deflection of the rails 30 in response to being impacted by the basketball.

As noted above, the angular displacement of the rails 30 is relatively small, generally not more than about five degrees from its initial position.

The net 28 exerts a frictional retarding force on the ball, so that the ball velocity is somewhat reduced as it travels through the net envelope. As previously indicated, training the straps 50 inside the net envelope forces the lower end of the net 28 to be directly over the rails 30 so that the ball will exit the net directly onto the rails. However, even when the net 28 is not present, the rail/strap assembly will still be operable to direct the ball onto the rail system.

The front ends of the rails 30 extend forward of the front edge of the circular rim 14, such that the rail front ends are about twelve or thirteen feet from the shooter, assuming he is standing at the foul line.

FIG. 1 shows in phantom the basketball 60 in contact with the cross member 44 near the lower ends of the rails 30. As the ball impacts the cross member 44, its vertical motion will be somewhat impeded. This will cause the ball to bounce off of the cross member 44 with a slight upward trajectory and will cause the ball to initially strike the floor at a point forward of the foul line, close to the rails 30, such that the ball will bounce to the shooter at a controllable height. The illustrated arrangement has been found to consistently deliver a basketball back to a shooter with approximately the same velocity and bounce trajectory.

A principal advantage of the illustrated construction is the fact that the rails 30 and the straps 50 are relatively inconspicuous, such that the shooter can readily concentrate his attention on the circular rim 14 and the backboard 12. The rails 30 and the straps 50 are visible, but they are not unduly distracting, to the same extent as the solid funnel structure shown in the aforementioned U.S. Pat. No. 3,814,421.

Another advantage of the illustrated arrangement is the fact that the ball return mechanism is composed of standard commercially available components, i.e. plastic or metal tubing, rubber straps, flat plate stock, rod stock, etc. There is substantially no tooling expense required for manufacture, therefore, the ball return mechanism can have a relatively low selling price, making it available to any person having a basketball goal. The ball return mechanism could be marketed as part of a basketball goal apparatus without appreciably increasing the selling price of the apparatus.

The ball return mechanism can be sold in a disassembled form with the component parts arranged parallel to one another in a tubular package having a relatively small transverse dimension.

The drawings show the rails 30 as straight linear tubes. They could, however, be curved along their lengths to form a concave guide structure. The use of circular cross-sectioned tubes as rails is advantageous in that the tubular shape is relatively strong and resistant to transverse bending. Also, the circular cross-section of the tube has minimal tendency to deflect the basketball directly upwardly.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. In association with a basketball goal that comprises a backboard, a circular rim horizontally oriented forward of the backboard, bracket means connecting the circular rim to the backboard, and a mechanism for deflecting a basketball forwardly in a direction away from said backboard after passage through said circular rim, said mechanism comprising:

two generally parallel rails disposed in the space below said circular rim and at an angle thereto, said rails having a length greater than the diameter of said circular rim;

said rails having rear ends located a predetermined distance behind said circular rim and connected to said bracket means below the plane of said circular rim, and front ends extending downwardly away from said circular rim preferable at an angle between 30 and 60 degrees;

said rails being located symmetrically in opposite transverse directions from a front-to-rear vertical plane passing through the central axis of said circular rim; and said rails being spaced apart by a distance that is less than the diameter of said basketball, whereby said basketball is caused to roll downwardly and forwardly between said rails after passage through said circular rim.

2. The mechanism of claim 1 wherein each of said rails is a hollow tube having a circular cross section.

3. The mechanism of claim 1 further comprising a cross member extending between said rails adjacent to said front ends.

4. The mechanism of claim 3 wherein said cross member extends into the path of said basketball when said basketball is rolling downwardly between said rails.

5. The mechanism of claim 3 wherein said rails are parallel to each other.

6. The mechanism of claim 1 further having two suspension straps connected to said circular rim at laterally spaced locations and connected at the opposite ends to said rails at locations near said front ends of said rails.

7. The mechanism of claim 6 wherein said suspension straps converge towards each other from said circular rim to said rails when viewed from a point directly above said circular rim.

8. The mechanism of claim 7 wherein each said suspension strap is a flexible strap having a length sufficient to support said rails at said angle.

9. The mechanism of claim 6 further comprising pivotable means for pivotably attaching said rear ends of each of said parallel rails to said bracket means.

10. The mechanism of claim 9 wherein said pivotable means includes a multi-piece clamp mechanism engageable against upper and lower surfaces of said bracket means.

11. The mechanism of claim 10 wherein said multi-piece clamp mechanism has a plate clamped to the underside of said bracket means, said plate having downturned ears engageable with side surfaces of said rails to maintain said rails in spaced apart relation, and further has an elongated rod transversely extending through said rails and associated ears to pivotably support said rails from said bracket means.

12. The mechanism of claim 11 wherein said rails are parallel to each other.

13. The mechanism of claim 11 wherein said rails are inclined in a front-to-rear direction at an angle preferably between thirty and sixty degrees relative to a plane formed by said basketball rim.

14. A mechanism connectable to a bracket mounting a basketball rim forward of a backboard for returning a basketball to a shooter after passage of the basketball through said basketball rim, said mechanism comprising a multi-piece clamping device attachable to said bracket between said basketball rim and said backboard, said multi-piece clamping device having a transverse pivot shaft, and two laterally spaced inclined rails, each rail of said two inclined rails having one end pivotably connected to said transverse pivot shaft, said two laterally spaced inclined rails disposable below said basketball rim to intercept said basketball after it has passed through said basketball rim and cause said basketball to roll downwardly along said two laterally spaced inclined rails in a direction towards the shooter.

15. The mechanism of claim 14 wherein said basketball has a predetermined diameter, said rails are spaced apart by a distance that is less than said predetermined diameter.

16. The mechanism of claim 15 wherein said inclined rails are inclined in a front-to-rear direction at an angle of approximately forty-five degrees.

17. The mechanism of claim 14 further comprising two laterally spaced straps, each of said two laterally spaced straps having one end connectable to said basketball rim and an opposite end connected to a respective one of said two laterally spaced inclined rails to support the ends of said two laterally spaced inclined rails opposite said one end.

18. A mechanism connectable to a bracket mounting a circular basketball rim forward of a backboard for directing a basketball back to a shooter after passage of the basketball downwardly through said circular basketball rim, said mechanism comprising:

a transverse pivot shaft connectable to said bracket between said backboard and said circular basketball rim;

two laterally spaced rails disposable below said circular basketball rim to intercept said basketball after passage through said circular basketball rim, one end of each of said two laterally spaced rails being pivotably attachable to said transverse pivot shaft, said two laterally spaced rails being inclinable in a front-to-rear direction towards the shooter to direct said intercepted basketball to roll downwardly between said two laterally spaced rails towards the shooter;

means connectable to said circular basketball rim for resiliently supporting said two laterally spaced rails in said front-to-rear direction to provide for a limited pivotal displacement of said two laterally spaced rails in response to the forces generated when said basketball is intercepted by at least one of said two laterally spaced rails; and a cross member extending between said two laterally spaced rails at a location near the ends thereof opposite said one end, said cross member extending into the path of said basketball when said basketball is rolling downwardly between said two laterally spaced rails.

19. The mechanism of claim 18 wherein said means for resiliently supporting comprises two resilient suspension straps having one end connectable to said circular basketball rim at laterally spaced locations and opposite ends connected to said two laterally spaced rails at a location near the ends of said two laterally spaced rails opposite said one end.

* * * * *

UNITED STATES PATENT AND TRADEMARK OFFICE

CERTIFICATE OF CORRECTION

PATENT NO. : 4,957,289

DATED : September 18, 1990

INVENTOR(S) : Jeffrey Kotlarz

It is certified that error appears in the above-identified patent and that said Letters Patent is hereby corrected as shown below:

ON TITLE PAGE:

At [76], please delete "Jeffery" and insert ---- Jeffrey ----.

Signed and Sealed this

Twelfth Day of May, 1992

*Attest:*

DOUGLAS B. COMER

*Attesting Officer*

*Acting Commissioner of Patents and Trademarks*